US009990912B2

(12) United States Patent
Kim et al.

(10) Patent No.: US 9,990,912 B2
(45) Date of Patent: Jun. 5, 2018

(54) ELECTRONIC DEVICE AND METHOD FOR REPRODUCING SOUND IN THE ELECTRONIC DEVICE

(71) Applicant: Samsung Electronics Co., Ltd., Suwon-si, Gyeonggi-do (KR)

(72) Inventors: Sung-Min Kim, Seoul (KR); Min-Hee Lee, Seoul (KR); Yun-Jae Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days. days.

(21) Appl. No.: 15/233,506

(22) Filed: Aug. 10, 2016

(65) Prior Publication Data

US 2017/0047057 A1 Feb. 16, 2017

(30) Foreign Application Priority Data

Aug. 11, 2015 (KR) ..... 10-2015-0113306

(51) Int. Cl.
*G10H 7/00* (2006.01)
*G10H 1/34* (2006.01)
*G10H 1/18* (2006.01)

(52) U.S. Cl.
CPC ..... *G10H 1/34* (2013.01); *G10H 1/183* (2013.01); *G10H 7/00* (2013.01); *G10H 2220/106* (2013.01); *G10H 2220/201* (2013.01); *G10H 2220/241* (2013.01); *G10H 2230/015* (2013.01)

(58) Field of Classification Search
CPC ..... G10H 1/34; G10H 1/183; G10H 7/00
USPC ..... 84/604
See application file for complete search history.

(56) References Cited

U.S. PATENT DOCUMENTS 5,009,147 A * 4/1991 Yamamori ..... G10H 1/18 84/618
2013/0239783 A1* 9/2013 Tabata ..... G10H 1/0008 84/609
2013/0239787 A1 9/2013 McMillen et al.
2015/0206521 A1* 7/2015 Sexton ..... G10H 3/146 84/609

FOREIGN PATENT DOCUMENTS

JP 4867940 B2 2/2012
KR 10-0622564 B1 9/2006

* cited by examiner

*Primary Examiner* — Jianchun Qin
(74) *Attorney, Agent, or Firm* — Jefferson IP Law, LLP

(57) ABSTRACT

An electronic device and a method for reproducing a sound in the electronic device are provided. The electronic device includes a touchscreen displaying a keyboard having a plurality of keys and a plurality of sound source buttons corresponding respectively to a plurality of different sound sources, a processor connected electrically to the touchscreen, and a memory connected electrically to the processor, wherein the memory stores instructions that are executed to cause the processor to perform control such that when an input to at least one key among the plurality of keys is received, the sound source corresponding to at least one sound source button selected among the plurality of sound source buttons is reproduced as a sound corresponding to the received input.

12 Claims, 9 Drawing Sheets

ELECTRONIC DEVICE AND METHOD FOR REPRODUCING SOUND IN THE ELECTRONIC DEVICE

CROSS-REFERENCE TO RELATED APPLICATION(S)

This application claims the benefit under 35 U.S.C. § 119(a) of a Korean patent application filed on Aug. 11, 2015 in the Korean Intellectual Property Office and assigned Serial No. 10-2015-0113306, the entire disclosure of which is hereby incorporated by reference.

TECHNICAL FIELD

The present disclosure relates to electronic devices and methods for reproducing (or playing) sounds in the electronic devices.

BACKGROUND

In general, musical instruments such as pianos may be used to generate sounds or play music. With the development of industry, musical instruments have been digitized and thus digital musical instruments such as electronic pianos (synthesizers) or samplers have emerged.

Such a digital musical instrument may digitize and store a sound source generated by a real musical instrument and may convert and reproduce the corresponding sound into a sound signal when played. For example, the digital musical instrument may be configured to reproduce a sound source such as a musical instrument sound in a storage medium when a musical instrument keyboard is pressed. The digital musical instrument may fetch and reproduce a digitized and stored single sound according to a keyboard input.

However, for example, when a keyboard is input, a digital musical instrument of the related art calls and reproduces a stored single sound source. Therefore, in response to a single keyboard input, the digital musical instrument of the related art may reproduce only a single stored sound source while failing to reproduce a plurality of sound sources.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device and a method for reproducing (or playing) a sound in the electronic device.

Thus, for example, various embodiments of the present disclosure are to provide electronic devices for reproducing a plurality of sound sources simultaneously or sequentially when receiving a key input of a digital musical instrument displayed on a screen thereof, and methods for reproducing sounds in the electronic devices.

In accordance with an aspect of the present disclosure, an electronic device is provided. The electronic device may include a touchscreen configured to display a keyboard having a plurality of keys and a plurality of sound source buttons corresponding respectively to a plurality of different sound sources, a processor connected electrically to the touchscreen, and a memory connected electrically to the processor, wherein the memory may be configured to store instructions that are executed to cause the processor to perform control such that when an input to at least one key among the plurality of keys is received, the sound source corresponding to at least one sound source button selected among the plurality of sound source buttons is reproduced as a sound corresponding to the received input.

In accordance with another aspect of the present disclosure, a method for reproducing a sound in an electronic device is provided. The method may include acquiring a sound source corresponding to at least one sound source button selected among a plurality of sound source buttons corresponding respectively to a plurality of different sound sources, receiving an input to at least one key of a keyboard displayed on a screen of the electronic device, and reproducing the sound source corresponding to the selected at least one sound source button as a sound corresponding to the received input.

In accordance with another aspect of the present disclosure, a non-transitory computer-readable recording medium storing a program executed in a computer is provided. The program may include instructions for acquiring a sound source corresponding to at least one sound source button selected among a plurality of sound source buttons corresponding respectively to a plurality of different sound sources, receiving an input to at least one key of a keyboard displayed on a screen of the electronic device, and reproducing the sound source corresponding to the selected at least one sound source button as a sound corresponding to the received input.

Other aspects, advantages, and salient features of the disclosure will become apparent to those skilled in the art from the following detailed description, which, taken in conjunction with the annexed drawings, discloses various embodiments of the pre sent disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
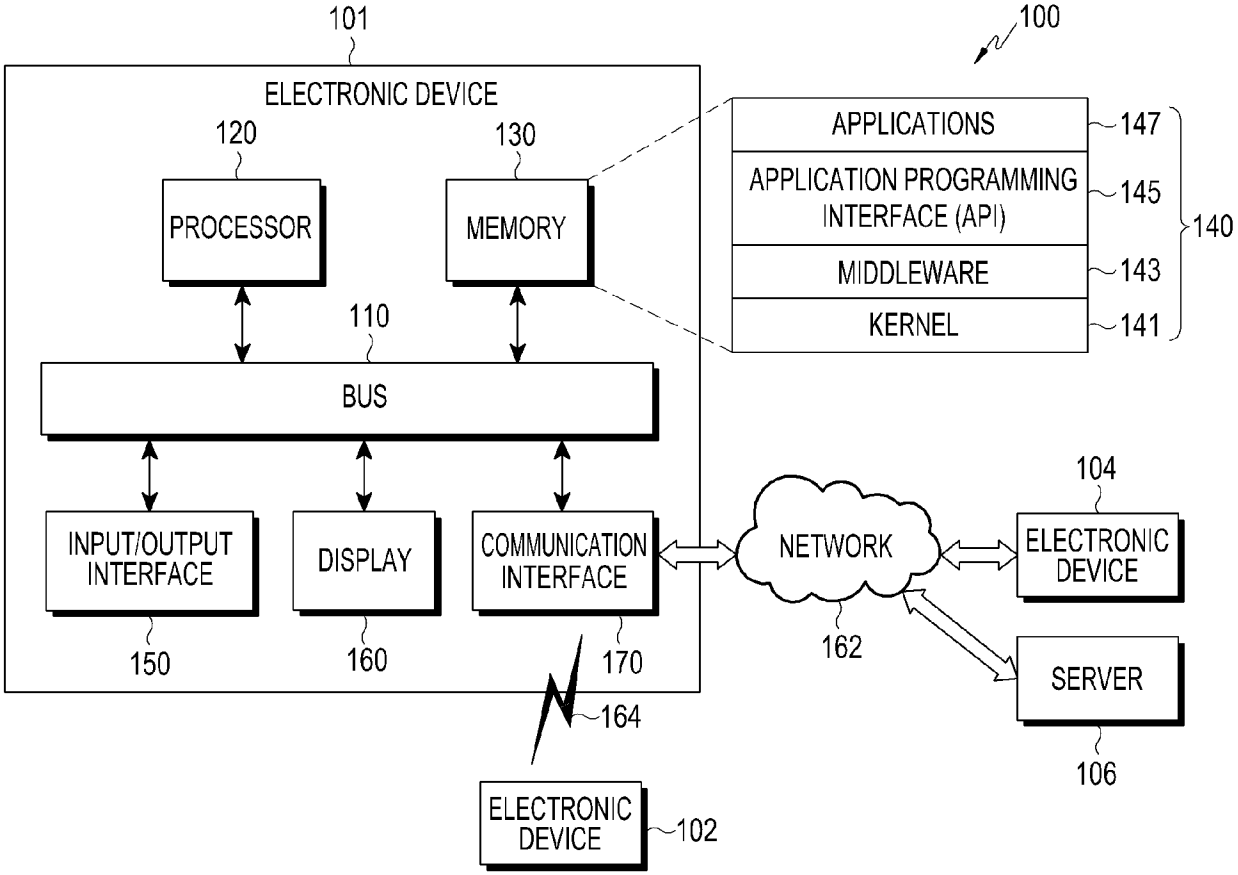
FIG. 1 is a diagram illustrating a network environment according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

When used herein, terms such as "comprise," "include," and "have" specify the presence of stated features (e.g., numerical values, functions, operations, parts, elements, and components) but do not preclude the presence or addition of one or more other features.

As used herein, expressions such as "A or B," "at least one of A and/or B," and "one or more of A and/or B" may include any and all combinations of one or more of the associated listed items. For example, "A or B," "at least one of A and B," or "at least one of A or B" may denote all of the cases of (1) including at least one A, (2) including at least one B, and (3) including at least one A and at least one B.

Terms such as "first" and "second" used herein may modify various elements or components regardless of their order and/or importance. These terms may be used only to distinguish one element or component from another element or component, and these elements or components should not be limited by these terms. For example, a first user device and a second user device may refer to different user devices regardless of their order or importance. For example, without departing from the scope of the present disclosure, a first component may be referred to as a second component, and vice versa.

It will be understood that when a component (e.g., a first component) is referred to as being "(operatively or communicatively) coupled to/with" or "connected to/with" another component (e.g., a second component), it may be coupled to/with or connected to/with the other component directly or indirectly through one or more other components (e.g., third components). On the other hand, when a component (e.g., a first component) is referred to as being "directly coupled to/with" or "directly connected to/with" another component (e.g., a second component), no other components (e.g., third components) exist therebetween.

The expression "configured to (or set to)" used herein may be replaced with, for example, "suitable for," "having the capacity to," "designed to," "adapted to," "made to," or "capable of" according to cases. The expression "configured to (or set to)" may not necessarily mean "specifically designed to" in a hardware level. Instead, in some case, the expression "apparatus configured to . . . " may mean that the apparatus is "capable of . . . " along with other devices or parts. For example, "a processor configured to (or set to) perform A, B, and C" may refer to a dedicated processor (e.g., an embedded processor) for performing a corresponding operation, or a general-purpose processor (e.g., a central processing unit (CPU) or an application processor (AP)) capable of performing a corresponding operation by executing one or more software programs stored in a memory device.

Unless otherwise defined, all terms (including technical or scientific terms) used herein may have the same meanings as commonly understood by those of ordinary skill in the art of the present disclosure. The terms defined in commonly used dictionaries may be interpreted as having the same meanings as the contextual meanings of the related art and will not be interpreted in an idealized or overly formal sense unless expressly so defined herein. In some cases, even the terms defined herein may not be interpreted to exclude the embodiments of the present disclosure.

An electronic device according to various embodiments of the present disclosure may include, for example, at least one of a smartphone, a tablet personal computer (PC), a mobile phone, a video phone, an e-book reader, a desktop PC, a laptop PC, a netbook computer, a workstation, a server, a personal digital assistant (PDA), a portable multimedia player (PMP), a Moving Picture Experts Group phase 1 or phase 2 (MPEG-1 or MPEG-2) audio layer 3 (MP3) player, a mobile medical device, a camera, or a wearable device. According to various embodiments of the present disclosure, the wearable device may include at least one of accessory-type devices (e.g., watches, rings, wristlets, anklets, necklaces, spectacles, contact lenses, or head-mounted devices (HMDs)), textile or clothing-integrated devices (e.g., electronic clothing), body-attachable devices (e.g., skin pads or tattoos), or bio-implantable devices (e.g., implantable circuits).

In some embodiments of the present disclosure, the electronic device may be a home appliance. The home appliance may include, for example, at least one of a television (TV), a digital versatile disc (DVD) player, an audio device, a refrigerator, an air conditioner, a cleaner, an oven, a microwave oven, a washing machine, an air cleaner, a set-top box, a home automation control panel, a security control panel, a TV box (e.g., Samsung HomeSync™, Apple TV™, or Goggle TV™), a game console (e.g., Xbox™ or PlayStation™), an electronic dictionary, an electronic key, a camcorder, or an electronic picture frame.

In other embodiments of the present disclosure, the electronic device may include at least one of any type of medical device (e.g., any type of portable medical meter (such as a blood sugar meter, a heart rate meter, a blood pressure meter, or a body temperature meter), a magnetic resonance angiography (MRA) device, a magnetic resonance imaging (MRI) device, a computerized tomography (CT) device, a tomograph, or an ultrasound machine), a navigation device, a global navigation satellite system (GNSS), an event data recorder (EDR), a flight data recorder (FDR), an automotive infotainment device, an electronic ship equipment (e.g., a ship navigation device or a gyrocompass), an avionic device, a security device, a vehicle head unit, an industrial or home robot, an automatic teller machine (ATM) of a financial institution, a point-of-sale (POS) device of a store, or an internet-of-things (IoT) device (e.g., an electric bulb, any type of sensor, an electricity or gas meter, a sprinkler, a fire alarm, a thermostat, a street lamp, a toaster, an exercise equipment, a hot-water tank, a heater, or a boiler).

According to some embodiments of the present disclosure, the electronic device may include at least one of a part of furniture or building/structure, an electronic board, an electronic signature receiving device, a projector, or any type of meter (e.g., a water meter, an electricity meter, a gas meter, or a radio wave meter). In various embodiments of the present disclosure, the electronic device may be any one or any combination of the above-described various devices. The electronic device according to some embodiments of the present disclosure may be a flexible electronic device. Also, the electronic device according to the embodiments of the present disclosure is not limited to the above-described devices and may include new electronic devices resulting from technology development.

Hereinafter, an electronic device according to various embodiments of the present disclosure will be described with reference to the accompanying drawings. As used herein, the term "user" may refer to a person using the electronic device, or a device (e.g., an artificial intelligence (AI) electronic device) using the electronic device.

An electronic device in a network environment according to various embodiments of the present disclosure will be described with reference to FIG. 1.

FIG. 1 is a diagram illustrating a network environment according to various embodiments of the present disclosure.

Referring to FIG. 1, the electronic device 101 in network environment 100 may include a bus 110, a processor 120, a memory 130, an input/output (I/O) interface 150, a display 160, and a communication interface 170. In some embodiments of the present disclosure, the electronic device 101 may not include at least one of the above components or may further include other components.

The bus 110 may include, for example, a circuit for connecting the above components (120 to 170) and transmitting communication information (e.g., control messages and/or data) between the above components.

The processor 120 may include at least one of a CPU, an AP, or a communication processor (CP). For example, the processor 120 may execute control of one or more other components of the electronic device 101 and/or data processings or operations related to communication.

The memory 130 may include a volatile memory and/or a nonvolatile memory. For example, the memory 130 may store data or commands related to one or more other components of the electronic device 101. According to an embodiment of the present disclosure, the memory 130 may store software and/or a program 140. The program 140 may include, for example, a kernel 141, middleware 143, an application programming interface (API) 145, and/or an application program (or "application") 147. At least a portion of the kernel 141, the middleware 143, and the API 145 may be referred to as an operating system (OS).

For example, the kernel 141 may control or manage system resources (e.g., the bus 110, the processor 120, or the memory 130) used to execute operations or functions implemented in other programs (e.g., the middleware 143, the API 145, or the application program 147). Also, the kernel 141 may provide an interface for controlling or managing the system resources when the middleware 143, the API 145, or the application program 147 accesses each component of the electronic device 101.

For example, the middleware 143 may perform a relay function so that the API 145 or the application program 147 may communicate data with the kernel 141.

Also, the middleware 143 may process one or more operation requests received from the application program 147 according to the priority thereof. For example, the middleware 143 may give at least one of the application programs 147 the priority to use the system resource (e.g., the bus 110, the processor 120, or the memory 130) of the electronic device 101. For example, the middleware 143 may perform scheduling or load balancing on the one or more operation requests by processing the one or more operation requests according to the priority given to the at least one.

For example, the API 145 may be an interface for the application 147 to control a function provided by the kernel 141 or the middleware 143, and may include at least one interface or function (e.g., instructions) for file control, window control, image processing, or character control.

For example, the I/O interface 150 may function as an interface for transmitting a command or data input from the user or another external device to one or more other components of the electronic device 101. Also, the I/O interface 150 may output a command or data received from one or more other components of the electronic device 101 to the user or another external device.

The display 160 may include, for example, a liquid crystal display (LCD), a light-emitting diode (LED) display, an organic LED (OLED) display, a microelectromechanical system (MEMS) display, or an electronic paper display. For example, the display 160 may display various types of content (e.g., texts, images, videos, icons, or symbols) to the user. For example, the display 160 may include a touch-screen and may receive a touch, gesture, proximity, or hovering input by using an electronic pen or a portion of the body of the user.

For example, the communication interface 170 may set the communication between the electronic device 101 and an external device (e.g., a first external electronic device 102, a second external electronic device 104, or a server 106). For example, by wireless communication or wired communication, the communication interface 170 may be connected to a network 162 to communicate with the external device (e.g., the second external electronic device 104 or the server 106).

The wireless communication may use, for example, at least one of long-term evolution (LTE), LTE Advanced (LTE-A), code division multiple access (CDMA), wideband CDMA (WCDMA), universal mobile telecommunications system (UMTS), wireless broadband (WiBro), and global system for mobile communication (GSM) as cellular communication protocol. Also, the wireless communication may include, for example, short-range communication 164. The short-range communication 164 may include, for example, at least one of Wi-Fi, Bluetooth (BT), near-field communication (NFC), ZigBee, Z-Wave, and GNSS. The GNSS may include, for example, at least one of global positioning system (GPS), global navigation satellite system (GLONASS), BeiDou navigation satellite system (hereinafter referred to as "BeiDou"), and Galileo (or the European global satellite-based navigation system) according to regions or bandwidths. Hereinafter, the term "GPS" may be interchangeably used with the term "GNSS". The wired communication may include, for example, at least one of universal serial bus (USB), high-definition multimedia interface (HDMI), recommended standard 232 (RS-232), and plain old telephone service (POTS). The network 162 may include, for example, at least one of a telecommunications network, a computer network (e.g., local area network (LAN) or wide area network (WAN)), the internet, and a telephone network.

Each of the first and second external electronic devices 102 and 104 may be similar to or different in type from the electronic device 101. According to an embodiment of the present disclosure, the server 106 may include a group of one or more servers. According to various embodiments of the present disclosure, all or some of the operations executed in the electronic device 101 may be executed in one or more other electronic devices (e.g., the external electronic device 102 or 104 or the server 106). According to an embodiment of the present disclosure, when the electronic device 101 needs to perform a function or a service automatically or at the request, the electronic device 101 may request at least some function related thereto from other devices (e.g., the external electronic device 102 or 104 or the server 106) in addition to or instead of directly executing the function or the service. The other devices (e.g., the external electronic device 102 or 104 or the server 106) may execute the requested function or the additional function and transmit the execution results to the electronic device 101. The electronic device 101 may provide the requested function or service by processing the received execution results additionally or without change. For this purpose, for example, cloud computing, distributed computing, or client-server computing technology may be used.

Hereinafter, electronic devices according to various embodiments of the present disclosure will be described with reference to the accompanying drawings.

Figure 2:
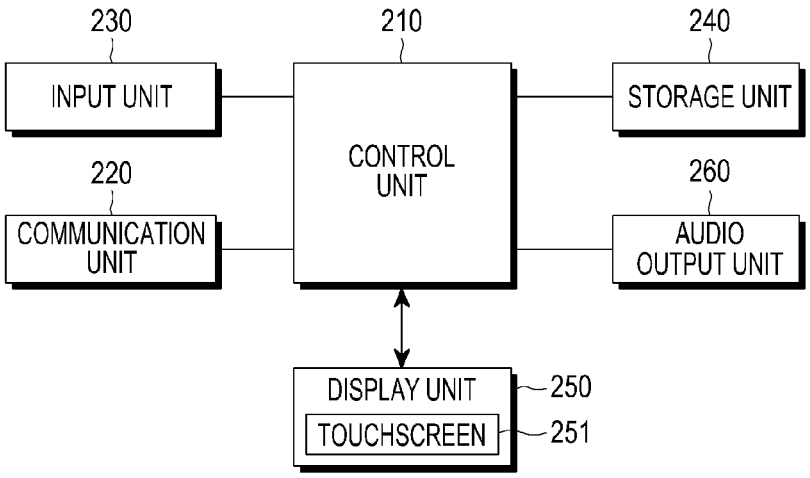
FIG. 2 is a diagram illustrating an example of a configuration of an electronic device according to various embodiments of the present disclosure.

FIG. 2 is a diagram illustrating an example of a configuration of an electronic device according to various embodiments of the present disclosure.

Referring to FIG. 2, according to various embodiments of the present disclosure, the electronic device (e.g., the electronic device 101 of FIG. 1) may be configured to include at least one of a control unit 210, a communication unit 220, an input unit 230, a storage unit 240, a display unit 250, and an audio output unit 260.

According to various embodiments of the present disclosure, the control unit 210 (e.g., the processor 120 of FIG. 1) may process information according to the operation of the electronic device and information according to the execution of programs, applications, or functions and may perform control to display the processed information on the display unit 250 or output a sound through the audio output unit 260.

According to various embodiments of the present disclosure, the control unit 210 may perform control to display various types of information (content) in all or some region on a screen of the display unit 250.

Also, according to various embodiments of the present disclosure, for example, the control unit 210 may include a sampler function such as a digital instrument and may perform control to produce and play a music through the sampler function by using at least one of the audio content stored in the storage unit 240, the audio content received from the server, and the sound source (e.g., voice or natural sound) input by the user. When an application performing a sampling function is executed, the control unit 210 may perform control such that a keyboard having a plurality of keys and a plurality of sound source buttons corresponding respectively to a plurality of different sound sources are displayed on the screen of the display unit 250. Also, when receiving an input to at least one key among a plurality of keys displayed on the screen, the control unit 210 may perform control such that the sound source corresponding to at least one sound source button selected among the plurality of sound source buttons is reproduced (or played) as a sound corresponding to the received input.

According to various embodiments of the present disclosure, the control unit 210 may preset a sound source corresponding to a plurality of sound source buttons before the production and reproduction of a sound source. According to various embodiments of the present disclosure, the control unit 210 may perform control to display a sound source setting button on the screen, may perform control to display a sound source setting screen when the sound source setting button is selected by the user, and may set each sound source corresponding to a plurality of sound source buttons. The set sound source may be at least one of the sound source stored in the storage unit 240, the sound source provided from the server, and the sound source input by the user, and may include at least one of a song, a user's voice, a musical instrument sound, and a natural sound.

According to various embodiments of the present disclosure, the control unit 210 may generate a sound of a pitch corresponding to each key included in the keyboard with respect to each of a plurality of sound sources preset as a sample and store the generated sound corresponding to each key as an output sound, and may call the output sound generated and stored corresponding to the key according to a user's key input and output the called output sound through the audio output unit 260.

According to various embodiments of the present disclosure, the control unit 210 may perform control to display a button for selecting a play mode on the screen. The play mode may include a single mode for reproducing one sound source at a time, a mix mode for simultaneously reproducing two or more sound sources selected among a plurality of sound source buttons, and a cycle mode for sequentially reproducing selected sound sources.

According to various embodiments of the present disclosure, in the mix mode, when two or more sound source buttons are selected by the user among the sound source buttons corresponding to a plurality of sound sources preset as a sample, the control unit 210 may perform control to simultaneously output the sound sources of the selected two or more sound source buttons as sounds of a pitch corresponding to an input key.

According to various embodiments of the present disclosure, in the cycle mode, when two or more sound source buttons are selected by the user among the sound source buttons corresponding to a plurality of sound sources preset as a sample, the control unit 210 may perform control to sequentially output the sound sources of the selected two or more sound source buttons as sounds of a pitch corresponding to an input key. Also, when a plurality of keys are input in the keyboard, the control unit 210 may perform control to sequentially output the selected sound sources as the sounds of the input keys according to the input order of the keys of the keyboard. According to various embodiments of the present disclosure, when there are two or more sound sources to be sequentially output, the control unit 210 may simultaneously output two or more sound sources whenever a key is input.

Also, according to various embodiments of the present disclosure, when an output sound is set to be recorded or stored in real time, the control unit 210 may perform control to record a plurality of output sounds output simultaneously or sequentially according to at least one key input (i.e., sound sources corresponding to a plurality of selected sound source buttons) and may perform control to fetch and edit a set of recorded output sounds, that is, a played music. Also, according to various embodiments of the present disclosure, when a sound source corresponding to a selected sound source button is set to be changed into another sound source, the control unit 210 may perform control to store the output sounds reproduced corresponding to the changed sound source button as a newly-changed sound source in a batch or with a set period changed in the process of editing the music including the reproduced and stored output sounds. Also, according to various embodiments of the present disclosure, in the process of editing the music produced by applying a plurality of sound sources, when at least one key is input after selection of a plurality of different sound source buttons, the control unit 210 may perform control to change the sounds corresponding to the key into the sound source corresponding to the currently-selected sound source button.

Also, according to various embodiments of the present disclosure, the control unit 210 may perform control to display the reproduction buttons on the touchscreen in order to reproduce the stored sound sources and may perform control to reproduce the stored sound sources according to the input of the reproduction button.

The control unit 210 according to various embodiments of the present disclosure may be a hardware component (function) or a software element (program) including at least one of various sensors provided in the electronic device, a data measuring module, an input/output interface, a module for managing the environment or the state of the electronic device, and a communication module, as a hardware module or a software module (e.g., an application program).

Also, according to various embodiments of the present disclosure, the control unit 210 of the electronic device may be at least a portion of the processor and may include, for example, software, firmware, or any combination thereof. According to various embodiments of the present disclosure, the control unit 210 may not include at least some of the above components, or may further include other components for performing an image processing operation in addition to the above components.

Also, according to various embodiments of the present disclosure, at least some components of the control unit 210 of the electronic device may be configured to include at least some of at least one processor including a CPU/micro processing unit (MPU) in a hardware level, at least one memory loaded with at least one piece of memory loading data (e.g., a register and/or a random-access memory (RAM)), and at least one bus for inputting/outputting at least one piece of data to the processor and the memory. Also, the control unit 210 may be configured to include a program routine or program data that may be loaded from a recording medium and then operation-processed by the processor in order to perform a function defined in the electronic device in a software level.

According to various embodiments of the present disclosure, the communication unit 220 (e.g., the communication interface 170 of FIG. 1) of the electronic device may communicate with another electronic device or an external device (e.g., the electronic device 102 or 104 or the server 106 of FIG. 1) under the control of the control unit 210. According to various embodiments of the present disclosure, the communication unit 220 may communicate data related to an executed operation with an external device under the control of the control unit 210. The communication unit 220 may communicate through a communication interface by the connection to a network or the connection between devices by using wireless communication or wired communication. The wireless communication may include, for example, at least one of Wi-Fi, BT, ZigBee, Z-Wave, NFC, GPS, and cellular communication (e.g., LTE, LTE-A, CDMA, WCDMA, UMTS, WiBro, or GSM). The wired communication may include, for example, at least one of USB, HDMI, RS-232, POTS, universal asynchronous receiver transmitter (UART), inter-integrated circuit (I2C), serial peripheral interface (SPI), and controller area network (CAN). Also, in addition to the above communication schemes, the communication unit 220 may include any other types of communication schemes that are widely known or to be developed in the future.

According to various embodiments of the present disclosure, the communication unit 220 may communicate with at least one external device (e.g., the electronic device 102 or 104 or the server 106 of FIG. 1) and may receive sound source samples for setting a plurality of sound sources and transmit the sound source samples to the control unit 210.

According to various embodiments of the present disclosure, the input unit 230 (e.g., the I/O interface 150 of FIG. 1) of the electronic device may transmit various information of number and character information input from the user and signals input in association with various function setting and function control of the electronic device, to the control unit 210. Also, the input unit 230 may support a user input for executing an application or a module supporting a particular function. The input unit 230 may include at least one of a key input unit such as a keyboard or a keypad, a touch input unit such as a touch sensor or a touch pad, a sound source input unit, a camera, and various sensors, and may also include a gesture input unit. In addition, the input unit 230 may include any other types of input units that are being developed or to be developed in the future. Also, according to various embodiments of the present disclosure, the input unit 230 may receive information input by the user through a camera or a touchscreen 251 of the display unit 250, and may transmit the input information to the control unit 210.

According to various embodiments of the present disclosure, the input unit 230 may transmit information related to a user's gesture received through a camera or various sensors, to the control unit 210. Also, the input unit 230 may transmit an input signal according to the selection of at least one object displayed on the screen (e.g., at least one button, at least one icon, or a plurality of keys included in the keyboard), to the control unit 210.

Also, according to various embodiments of the present disclosure, the input unit 230 may receive an input of sound source samples, which will be set as a plurality of sound sources, from the user through a sound source input unit (e.g., a microphone) and transmit the sound source samples to the control unit 210. Also, the input unit 230 may be an input unit capable of receiving a selection input of the button displayed on the touchscreen, and may receive an input to a mode switch button, a plurality of sound source buttons, or at least one key included in the keyboard and transmit an input signal thereof to the control unit 210. Also, the input unit 230 may transmit sense signal (e.g., illuminance information) sensed through a sensor (e.g., a touch sensor), to the control unit 210.

According to various embodiments of the present disclosure, the storage unit 240 (e.g., the memory 130 of FIG. 1) of the electronic device may temporarily store a program necessary for a functional operation according to various embodiments of the present disclosure and various data generated during program execution. The storage unit 240 may generally include a program region and a data region. The program region may store related information for driving the electronic device, such as an OS for booting the electronic device. The data region may store generated data and transmitted or received data according to various embodiments of the present disclosure. Also, the storage unit 240 may be configured to include at least one storage medium among a flash memory, a hard disk, a multimedia card micro type memory (e.g., secure digital (SD) or extreme digital (XD) memory), a RAM, and a read only memory (ROM).

According to various embodiments of the present disclosure, the storage unit 240 may store the content (e.g., audio information) received from the external device and may store the information received from the external device or the internal sensors. Also, according to various embodiments of the present disclosure, the storage unit 240 may store the sound sources input by the user through the microphone and the sound sources received from the external device and may store the sound source corresponding to each of a plurality of sound source buttons preset as a sample to be used for sound source reproduction. Also, according to various embodiments of the present disclosure, when receiving an input to at least one key among the plurality of keys, the storage unit 240 may include instructions for performing control such that the sound source corresponding to at least one sound source button selected among the plurality of sound source buttons is reproduced as a sound corresponding to the received input. Also, the storage unit 240 may store the sound reproduced as the sound corresponding to the pitch of the key input by the user with respect to the sound source corresponding to the selected sound source button and may store the music produced or edited by the reproduced sounds.

According to various embodiments of the present disclosure, the display unit 250 (e.g., the display 160 or a portion of the I/O interface 150 of FIG. 1) of the electronic device may output the operation execution result information (e.g., at least one of texts, images, and moving images) under the control of the control unit 210.

The display unit 250 may display an input pad (e.g., button) for inputting at least one of various characters, numbers, or symbols into an input window on the screen, in various ways. Also, the display unit 250 may display a service execution screen according to the execution of various applications related to information communication.

According to various embodiments of the present disclosure, the display unit 250 may display a keyboard having a plurality of keys and a plurality of sound source buttons corresponding respectively to a plurality of different sound sources on the screen. Also, according to various embodiments of the present disclosure, the display unit 250 may display a mode button for selecting a mode for reproducing the sound source corresponding to the selected at least one sound source button, in a region on the screen. Also, according to various embodiments of the present disclosure, the display unit 250 may set the sound sources corresponding to a plurality of sound source buttons, receive an input of the sample sound sources necessary for sound source setting, and display an edit screen for editing the reproduced sound or the produced music.

Also, according to various embodiments of the present disclosure, when the display unit 250 of the electronic device is implemented in a form having the touchscreen 251, it may correspond to a touchscreen of an input unit (not illustrated). When the display unit 250 is implemented together with the input unit 230 in the form having the touchscreen 251, it may display various information generated according to the user's touch operation.

Also, according to various embodiments of the present disclosure, the display unit 250 of the present disclosure may include at least one of an LCD, a thin film transistor LCD (TFT-LCD), an OLED display, an LED display, an active matrix OLED (AMOLED) display, a flexible display, and a three-dimensional (3D) display. Also, some displays among them may be configured to be transparent or photo-transparent to the outside thereof. This may be configured in the form of a transparent display including a transparent OLED (TOLED).

Also, according to various embodiments of the present disclosure, in addition to the display unit 250, the electronic device may further include another attached display unit (e.g., an extended display unit or a flexible display unit) and/or a display unit of another external electronic device (e.g., at least one of an external display device, a wearable device, and an external terminal device) interacting with the electronic device.

According to various embodiments of the present disclosure, the audio output unit 260 (e.g., the I/O interface 150 of FIG. 1) of the electronic device may output a sound and may be configured to include, for example, at least one of an audio codec, a microphone (MIC), a receiver, an earphone output (EAR_L), and a speaker. According to various embodiments of the present disclosure, when receiving an input to at least one key among a plurality of keys, the audio output unit 260 may output the sound source corresponding to at least one sound source button selected among a plurality of sound source buttons, as a sound corresponding to the received input. Also, the audio output unit 260 may output the sample sound sources to be set for setting the sound source corresponding to each of a plurality of sound source buttons.

Also, according to various embodiments of the present disclosure, the electronic device may be configured to further include a vibration output unit or an odor output unit.

The main components of the electronic device according to various embodiments of the present disclosure have been described above with reference to FIG. 2. However, in various embodiments of the present disclosure, not all of the components illustrated in FIG. 2 are indispensable components, and the electronic device may be implemented by more or less components than the illustrated components. Also, the positions of the main components of the electronic device described above with reference to FIG. 2 may vary according to various embodiments of the present disclosure. Also, the function of each component of the electronic device described above with reference to FIGS. 1 and 2 may also be similarly or partially applied to the operation processes of the electronic device according to various embodiments of the present disclosure, which will be described later.

According to one of various embodiments of the present disclosure, an electronic device may include a touchscreen displaying a keyboard having a plurality of keys and a plurality of sound source buttons corresponding respectively to a plurality of different sound sources, a processor connected electrically to the touchscreen, and a memory connected electrically to the processor, wherein the memory may store instructions that are executed to cause the processor to perform control such that when an input to at least one key among the plurality of keys is received, the sound source corresponding to at least one sound source button selected among the plurality of sound source buttons is reproduced as a sound corresponding to the received input.

According to various embodiments of the present disclosure, the processor may generate an output sound as a sound of a pitch corresponding to each key included in the keyboard, with respect to each of the plurality of sound sources.

According to various embodiments of the present disclosure, the processor may perform control such that the sound sources corresponding to at least two sound source buttons selected among the plurality of sound source buttons are simultaneously output as sounds of a pitch corresponding to the input to the key.

According to various embodiments of the present disclosure, the processor may perform control such that the sound sources corresponding to at least two sound source buttons selected among the plurality of sound source buttons are sequentially output as sounds of a pitch corresponding to the input to the key.

According to various embodiments of the present disclosure, when inputs to two or more keys in the keyboard are received and a plurality of sound source buttons are selected, the processor may perform control such that sound sources corresponding to different sound source buttons are sequentially output according to the order of the inputs to the two or more keys.

According to various embodiments of the present disclosure, the processor may perform control such that at least one sound source button not displayed on the screen is displayed on the screen according to a user's gesture for moving the plurality of sound source buttons displayed on the display unit.

According to various embodiments of the present disclosure, the processor may display a button for selecting a play mode on the screen, and display a scroll bar for displaying a key not displayed on the screen by moving a plurality of keys of the keyboard displayed on the screen.

According to various embodiments of the present disclosure, the memory may store different sound sources set corresponding respectively to the plurality of sound source buttons.

According to various embodiments of the present disclosure, the sound source may include at least one of prestored audio content, a user's voice input from the user, or a natural sound input by the user.

An operation process for reproducing a sound in the electronic device as described above will be described in detail with reference to the accompanying drawings.

Figure 3:
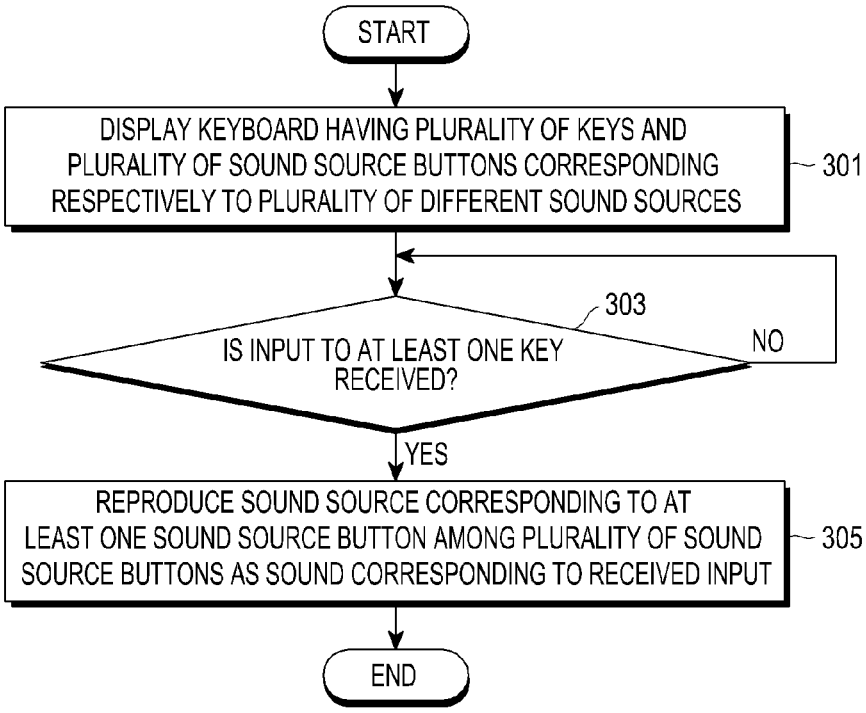
FIG. 3 is a diagram illustrating an example of an operation process of an electronic device according to various embodiments of the present disclosure.
Figure 4:
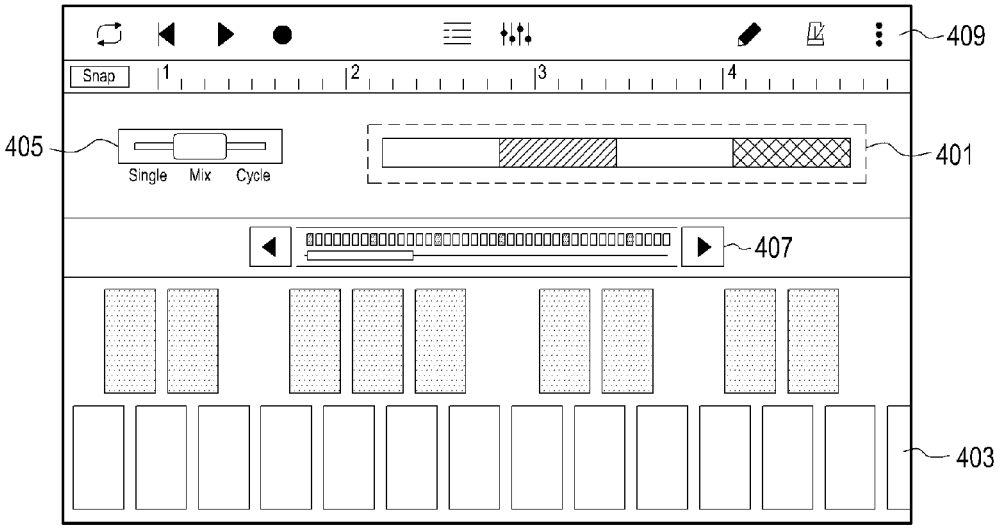
FIG. 4 is a diagram illustrating an example of a screen in an electronic device according to various embodiments of the present disclosure.
Figure 5:
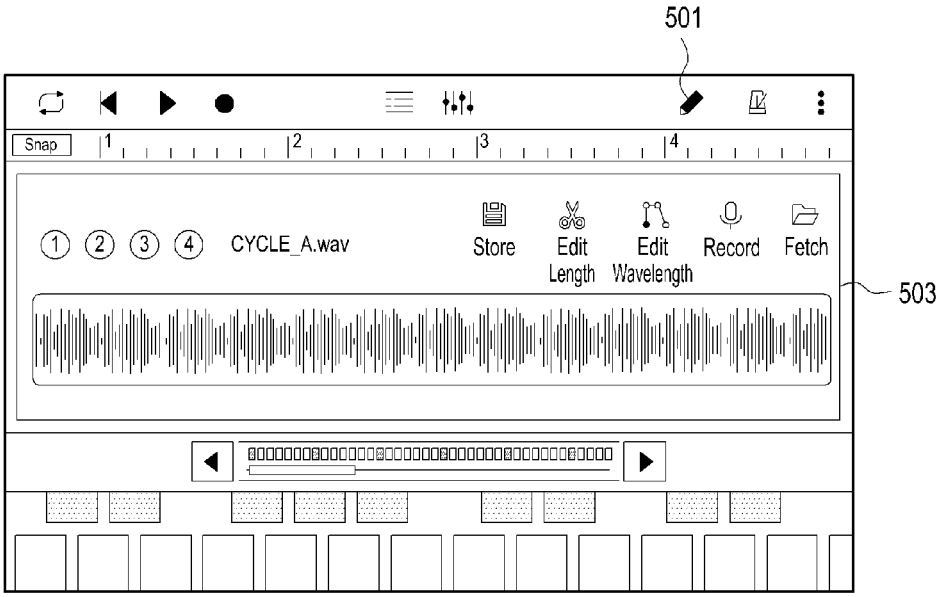
FIG. 5 is a diagram illustrating an example of a screen in an electronic device according to various embodiments of the present disclosure.

FIG. 3 is a diagram illustrating an example of an operation process of an electronic device according to various embodiments of the present disclosure, FIG. 4 is a diagram illustrating an example of a screen in an electronic device according to various embodiments of the present disclosure, and FIG. 5 is a diagram illustrating an example of a screen in an electronic device according to various embodiments of the present disclosure.

Referring to FIG. 3, according to various embodiments of the present disclosure, in operation 301, when an operation for sound source reproduction is executed by the user, the electronic device (e.g., the electronic device 101 of FIG. 1) may display a keyboard having a plurality of keys and a plurality of sound source buttons corresponding respectively to a plurality of different sound sources.

Referring to FIG. 4, the electronic device may display a plurality of sound source buttons 401 corresponding respectively to preset sound sources, a keyboard 403 including a plurality of keys, and a button 405 for selecting a play mode, on the screen. Also, the electronic device may display a navigator 407 (or a scroll button) for moving the keyboard 403 such that the keys of the keyboard 403 not displayed on the screen are displayed on the screen. Also, as illustrated in FIG. 4, the electronic device may display buttons 409 for environment setting.

Referring to FIG. 5, when receiving an input to a button 501 for sample sound source editing among the buttons 409 for environment setting, the electronic device may switch to an edit mode and display a screen 503 for setting a sound source corresponding to each of a plurality of sound source buttons or editing a reproduced sound (e.g., a reproduced music).

In operation 303, the electronic device may determine whether an input to at least one key is received. As a result of the determination, when an input to at least one key is received, operation 305 may be performed. And when an input to at least one key is not received, operation 303 may be performed again.

In operation 305, the electronic device may reproduce the sound source corresponding to at least one sound source button selected among the plurality of sound source buttons as a sound corresponding to the received input.

According to one of various embodiments of the present disclosure, a method for reproducing a sound in an electronic device may include acquiring a sound source corresponding to at least one sound source button selected among a plurality of sound source buttons corresponding respectively to a plurality of different sound sources, receiving an input to at least one key of a keyboard displayed on a screen of the electronic device, and reproducing the sound source corresponding to the selected at least one sound source button as a sound corresponding to the received input.

According to various embodiments of the present disclosure, the reproducing of the sound source corresponding to the selected at least one sound source button as the sound corresponding to the received input may include generating output sounds respectively as sounds of a pitch corresponding to the input to the key, with respect to the sound sources corresponding respectively to at least two sound source buttons selected among the plurality of sound source buttons, and outputting the generated output sounds simultaneously.

According to various embodiments of the present disclosure, the reproducing of the sound source corresponding to the selected at least one sound source button as the sound corresponding to the received input may include generating output sounds respectively as sounds of a pitch corresponding to the input to the key, with respect to the sound sources corresponding respectively to at least two sound source buttons selected among the plurality of sound source buttons, and outputting the generated output sounds sequentially.

According to various embodiments of the present disclosure, the reproducing of the sound source corresponding to the selected at least one sound source button as the sound corresponding to the received input may include, when receiving inputs to two or more keys in the keyboard, performing control such that sound sources corresponding to different sound source buttons are sequentially output according to the order of the inputs to the two or more keys.

According to various embodiments of the present disclosure, the method may further include displaying at least one sound source button not displayed on the screen, on the screen according to a user's gesture for moving the plurality of displayed sound source buttons.

According to various embodiments of the present disclosure, the method may further include displaying a key not displayed on the screen by moving a plurality of keys of the keyboard displayed on the screen.

According to various embodiments of the present disclosure, the sound source may include at least one of prestored audio content, a user's voice input from the user, or a natural sound input by the user.

A more detailed operation process for sound source reproduction according to the operation process of the electronic device according to various embodiments of the present disclosure as described above will be described with reference to the accompanying drawings.

Figure 6:
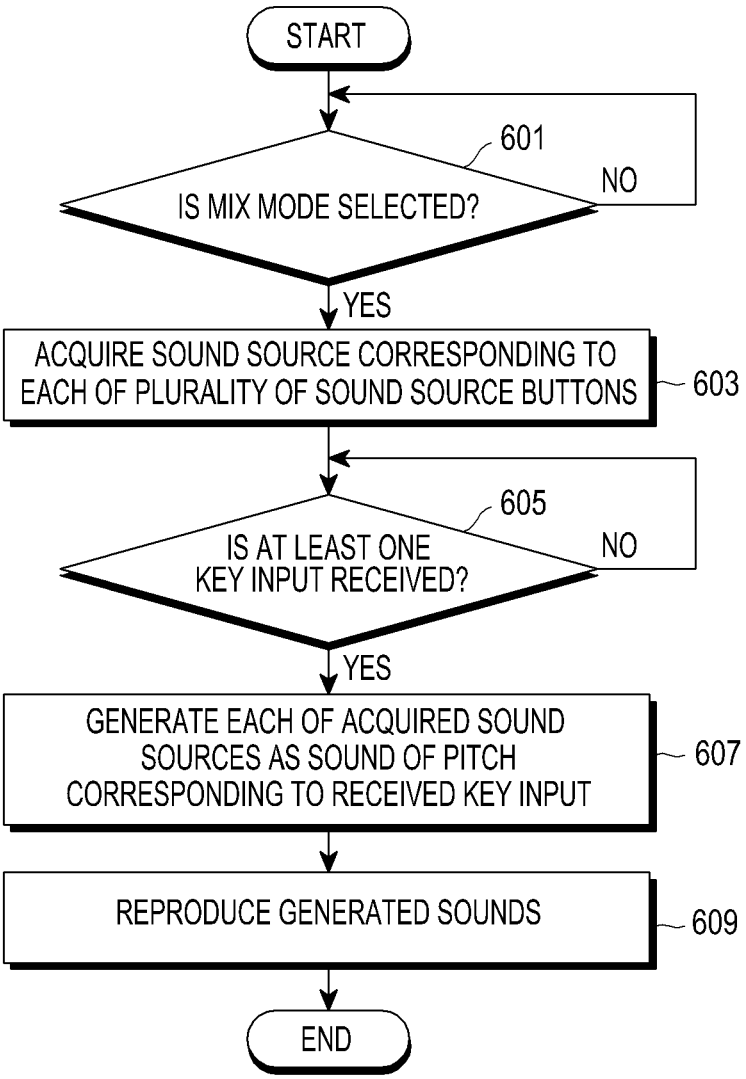
FIG. 6 is a diagram illustrating an example of an operation process of an electronic device according to various embodiments of the present disclosure.

FIG. 6 is a diagram illustrating an example of an operation process of an electronic device according to various embodiments of the present disclosure.

Referring to FIG. 6, according to various embodiments of the present disclosure, in operation 601, the electronic device (e.g., the electronic device 101 of FIG. 1) may determine whether it switches to and operates in a mix mode. As a result of the determination, when the electronic device does not operate in a mix mode, the electronic device may perform an operation of another mode or wait for an operation of a mix mode. On the other hand, as a result of the determination, when the electronic device operates in a mix mode, the electronic device may perform operation 603.

In operation 603, the electronic device may acquire a sound source corresponding to each of a plurality of sound source buttons. According to various embodiments of the present disclosure, the electronic device may determine whether a sound source corresponding to a plurality of sound source buttons (e.g., four sound source buttons) is set and may output a preset sound source according to a user's particular gesture (e.g., at least one of a sound source selection (e.g., at least one of touch, long touch, and double touch) and a swipe in a particular direction) when the sound source is set. Accordingly, the user may detect the output sound source and thus may determine whether to reset or use the detected sound source for playing. According to various embodiments of the present disclosure, as illustrated in FIG. 5, when a sound source corresponding to a plurality of sound source buttons is not set by the user or resetting is requested, the electronic device may switch to a setting screen, receive an input of the stored sample sound sources or an input of the sound source directly from the user through a microphone, and set the sound source corresponding to each of the plurality of sound source buttons. Also, according to various embodiments of the present disclosure, when at least one sound source button is selected by the user, the electronic device may receive an input of the sound source, which is to be set for the selected sound source button, directly from the user and store the input sound source as the sound source corresponding to the selected sound source button.

According to various embodiments of the present disclosure, the electronic device may call and acquire the sound sources corresponding to two or more sound source buttons selected among a plurality of sound source buttons, or may call and acquire the sound sources corresponding respectively to the preset sound source buttons.

In operation 605, the electronic device may determine whether an input to at least one key included in the keyboard is received. As a result of the determination, when at least one key input is received, operation 607 may be performed. And when at least one key input is not received, operation 605 may be performed again.

In operation 607, the electronic device may generate an output sound as a sound of a pitch corresponding to the key input, with respect to each of the acquired sound sources.

In operation 609, the electronic device may reproduce the generated sounds (output sounds) simultaneously.

Figure 7:
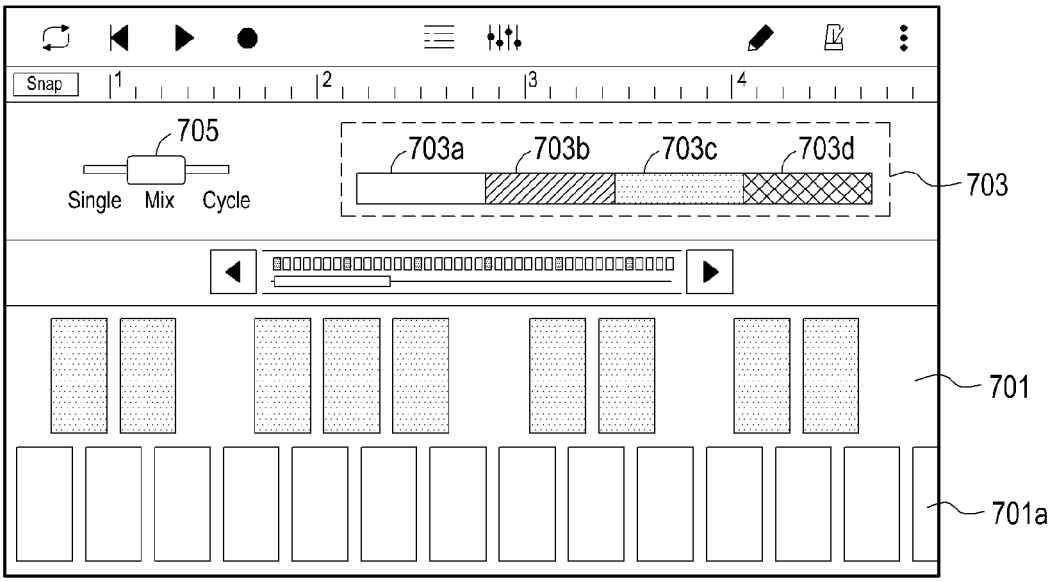
FIG. 7 is a diagram illustrating an example of a screen in an electronic device according to various embodiments of the present disclosure.

FIG. 7 is a diagram illustrating an example of a screen in an electronic device according to various embodiments of the present disclosure.

Referring to FIG. 7, according to various embodiments of the present disclosure, when the user selects a mix mode from a play mode selection button 705 displayed on the screen, the electronic device may receive an input of each of two or more sound source buttons 703*a* and 703*c* selected among a plurality of sound source buttons 703 (703*a*, 703*b*, 703*c*, and 703*d*) set to reproduce a sound source in the mix mode. When receiving an input of at least one key 701*a* in a keyboard 701 from the user, the electronic device may call the sound sources corresponding to the selected two or more sound source buttons 703*a* and 703*c* and simultaneously reproduce the called sound sources as sounds of a pitch corresponding to the at least one key input. Also, according to various embodiments of the present disclosure, when receiving an input of two or more keys, the electronic device may reproduce the sound source corresponding to the first-selected sound source button 703*a* as the corresponding output sound (e.g., the sound source for "Do") with respect to a key (e.g., "Do") and reproduce the sound source corresponding to the second-selected sound source button 703*c* as the corresponding output sound (e.g., the sound source for "Mi") with respect to another key (e.g., "Mi"). In this case, the output sounds corresponding to the two or more keys may be reproduced simultaneously.

Figure 8:
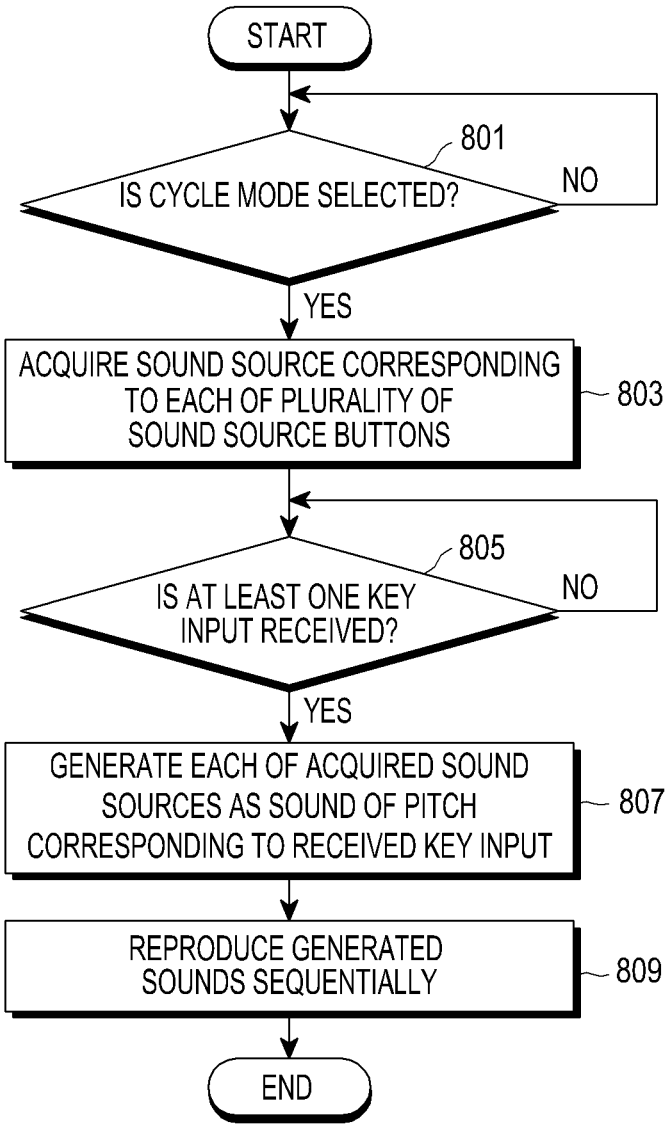
FIG. 8 is a diagram illustrating an example of an operation process of an electronic device according to various embodiments of the present disclosure.

FIG. 8 is a diagram illustrating an example of an operation process of an electronic device according to various embodiments of the present disclosure.

Referring to FIG. 8, according to various embodiments of the present disclosure, in operation 801, the electronic device (e.g., the electronic device 101 of FIG. 1) may determine whether it switches to and operates in a cycle mode. As a result of the determination, when the electronic device does not operate in a cycle mode, the electronic device may perform an operation of another mode or wait for an operation of a cycle mode. On the other hand, as a result of the determination, when the electronic device operates in a cycle mode, the electronic device may perform operation 803.

In operation 803, the electronic device may acquire a sound source corresponding to each of a plurality of sound source buttons. According to various embodiments of the present disclosure, the electronic device may determine whether a sound source corresponding to a plurality of sound source buttons (e.g., four sound source buttons) is set and may output a preset sound source according to a user's particular gesture (e.g., at least one of a sound source selection (e.g., at least one of touch, long touch, and double touch) and a swipe in a particular direction) when the sound source is set. Accordingly, the user may detect the output sound source and thus may determine whether to reset or use the detected sound source for playing. According to various embodiments of the present disclosure, as illustrated in FIG. 5, when a sound source corresponding to a plurality of sound source buttons is not set by the user or resetting is requested, the electronic device may switch to a setting screen, receive an input of the stored sample sound sources or an input of the sound source directly from the user through a microphone, and set the sound source corresponding to each of the plurality of sound source buttons. Also, according to various embodiments of the present disclosure, when at least one sound source button is selected by the user, the electronic device may receive an input of the sound source, which is to be set for the selected sound source button, directly from the user and store the input sound source as the sound source corresponding to the selected sound source button.

According to various embodiments of the present disclosure, the electronic device may call and acquire the sound sources corresponding to two or more sound source buttons selected among a plurality of sound source buttons, or may call and acquire the sound sources corresponding respectively to the preset sound source buttons.

In operation 805, the electronic device may determine whether an input to at least one key included in the keyboard is received. As a result of the determination, when at least one key input is received, operation 807 may be performed. And when at least one key input is not received, operation 805 may be performed again. According to various embodiments of the present disclosure, the electronic device may receive a repeated input of at least one key or may receive an input of a plurality of keys.

In operation 807, the electronic device may sequentially generate output sounds in the order of sounds of a pitch corresponding to the key input, with respect to each of the acquired sound sources.

In operation 809, the electronic device may reproduce the generated sounds (output sounds) sequentially.

Figure 9:
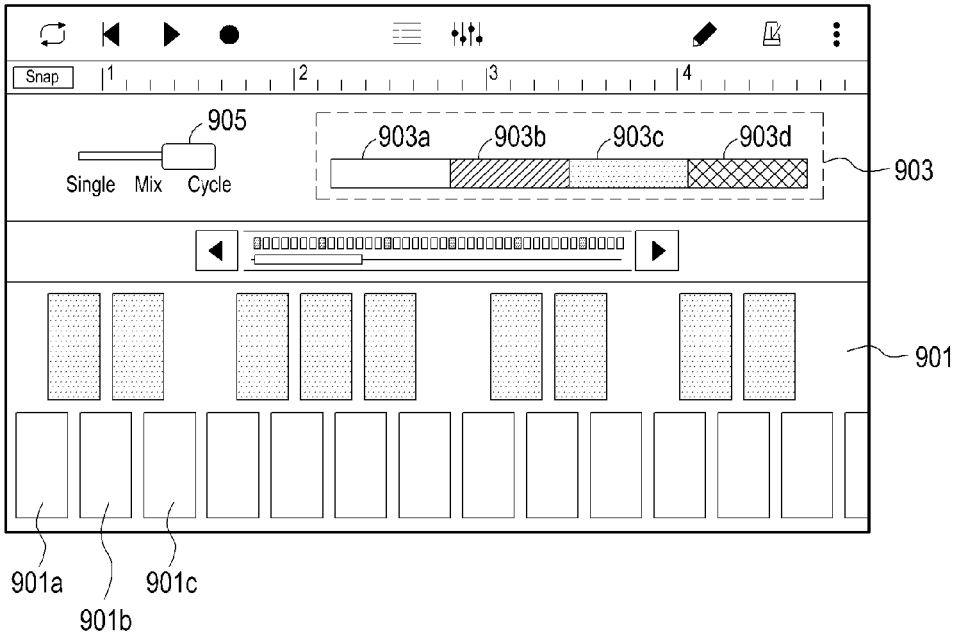
FIG. 9 is a diagram illustrating an example of a screen in an electronic device according to various embodiments of the present disclosure.

FIG. 9 is a diagram illustrating an example of a screen in an electronic device according to various embodiments of the present disclosure.

Referring to FIG. 9, according to various embodiments of the present disclosure, when the user selects a cycle mode from a play mode selection button 905 displayed on the screen, the electronic device may receive an input of each of two or more sound source buttons 903*a* and 903*c* selected among a plurality of sound source buttons 903 (903*a*, 903*b*, 903*c*, and 903*d*) set to reproduce a sound source in the cycle mode. When receiving an input of a plurality of keys 901*a*, 901*b*, and 901*c* in a keyboard 901 from the user, the electronic device may call the sound sources corresponding to the selected two or more sound source buttons 903*a* and 903*c* and sequentially reproduce the called sound sources in the order of sounds of a pitch corresponding to the at least one key input. According to various embodiments of the present disclosure, the electronic device may sequentially output the sound sources corresponding to a plurality of selected sound source buttons in the order of pressing a plurality of received keys 901*a*, 901*b*, and 901*c*. For example, when two or more sound source buttons 903*a* and 903*c* are selected, and when receiving an input of the first key 901*a* (e.g., "Do" of the keyboard), the electronic device may output the sound source corresponding to the first sound source button 903*a* as the output sound (e.g., the sound source for "Do") corresponding to the sound (e.g., "Do") of the first key 901*a*. And thereafter, when receiving an input of the second key 901*b* (e.g., "Re" of the keyboard), the electronic device may output the sound source corresponding to the second sound source button 903*b* as the output sound (e.g., the sound source for "Re") corresponding to the sound (e.g., "Re") of the second key 901*b*. Subsequently, when receiving an input of the third key 901*c* (e.g., "Mi" of the keyboard), the electronic device may output the sound source corresponding to the first sound source button 903*a* as the output sound (e.g., the sound source for "Mi") corresponding to the sound (e.g., "Mi") of the third key 901*c*. Also, according to various embodiments of the present disclosure, when one key 901*a* in the keyboard 901 is repeatedly pressed, the electronic device may output a plurality of selected sound source buttons 903*a*, 903*b*, 903*c* sequentially in a predetermined order.

As described above, the electronic device (e.g., the electronic device 101 of FIG. 1) according to various embodiments of the present disclosure displays the play mode selection button on the screen so that it may be selected by the user for playing. However, according to other embodiments of the present disclosure, the electronic device may operate in a preset play mode without displaying the play mode selection button. According to various embodiments of the present disclosure, the electronic device may be set to play in a mixture of at least two modes among a single mode, a mix mode, and a cycle mode. According to various embodiments of the present disclosure, the electronic device may be set to operate in a mix mode when some of a plurality of sound source buttons are selected, and may be set to operate in a mix mode when some of the other source buttons are selected. For example, as illustrated in FIG. 9, when the first and second sound source buttons 903*a* and 903*b* are selected among the sound source buttons 903*a*, 903*b*, 903*c*, and 903*d*, the electronic device may simultaneously output the sound sources corresponding respectively to the first and second sound source buttons 903*a* and 903*b* selected according to the input of at least one key, as the sound of the input key. Also, when the second and fourth sound source buttons 903*b* and 903*d* are selected, the electronic device may sequentially output the sound sources corresponding respectively to the first and second sound source buttons 903*a* and 903*b* selected according to the input of at least one key, as the sound of the input key.

According to various embodiments of the present disclosure, the electronic device may be set to have different play modes according to the octaves or the types of keyboards (e.g., white keyboard and black keyboard).

Figure 10:
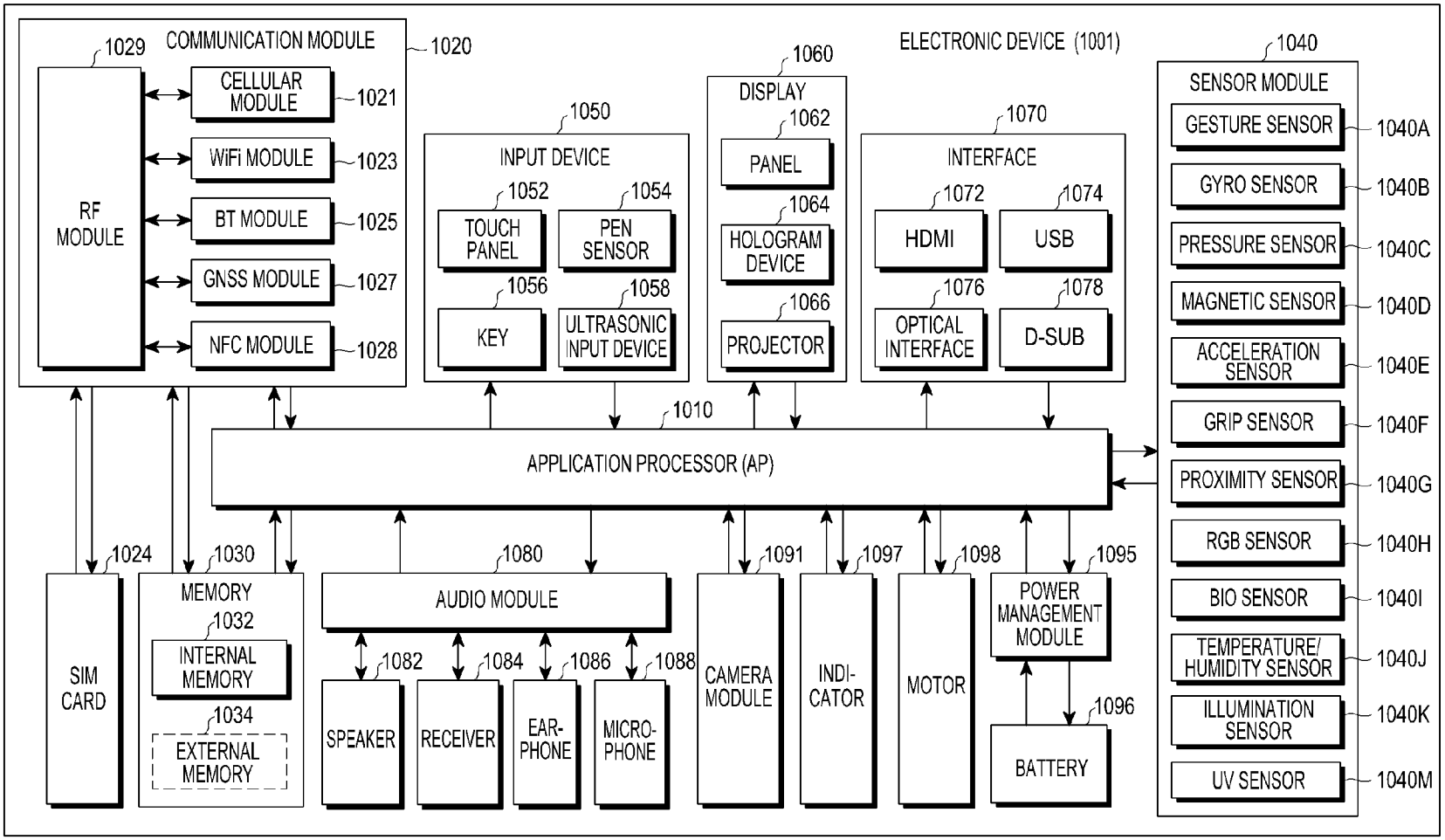
FIG. 10 is a block diagram of an electronic device according to various embodiments of the present disclosure.

FIG. 10 is a block diagram of an electronic device according to various embodiments of the present disclosure.

Referring to FIG. 10, the electronic device 1001 may include, for example, all or some of the electronic device 101 illustrated in FIG. 1. The electronic device 1001 may include at least one processor (e.g., AP) 1010, a communication module 1020, a subscriber identification module (SIM) 1024, a memory 1030, a sensor module 1040, an input device 1050, a display 1060, an interface 1070, an audio module 1080, a camera module 1091, a power management module 1095, a battery 1096, an indicator 1097, and a motor 1098.

For example, by driving an OS or an application program, the processor 1010 may control a plurality of hardware or software components connected to the processor 1010 and perform various data processings and operations. The processor 1010 may be implemented, for example, as a system on chip (SoC). According to an embodiment of the present disclosure, the processor 1010 may further include a graphic processing unit (GPU) and/or an image signal processor (ISP). The processor 1010 may include at least some (e.g., cellular module 1021) of the components illustrated in FIG. 10. The processor 1010 may load a command or data received from at least one of other components (e.g., a nonvolatile memory) into a volatile memory and process the loaded data, and the processor 1010 may store various data in the nonvolatile memory.

The communication module 1020 may have an identical or similar configuration to the communication interface 170 of FIG. 1. The communication module 1020 may include, for example, the cellular module 1021, a Wi-Fi module 1023, a BT module 1025, a GNSS module 1027 (e.g., a GPS module, a GLONASS module, a BeiDou module, or a Galileo module), an NFC module 1028, and a radio frequency (RF) module 1029.

The cellular module 1021 may provide, for example, a voice call service, a video call service, a text message service, or an internet service through a communication network. According to an embodiment of the present disclosure, the cellular module 1021 may identify and authenticate the electronic device 1001 in the communication network by using the SIM (e.g., SIM card) 1024. According to an embodiment of the present disclosure, the cellular module 1021 may perform at least some of the functions that may be provided by the processor 1010. According to an embodiment of the present disclosure, the cellular module 1021 may include a CP.

Each of the Wi-Fi module 1023, the BT module 1025, the GNSS module 1027, and the NFC module 1028 may include, for example, a processor for processing data transmitted/received through the corresponding module. According to some embodiments of the present disclosure, at least some (e.g., two or more) of the cellular module 1021, the Wi-Fi module 1023, the BT module 1025, the GNSS module 1027, and the NFC module 1028 may be included in an integrated chip (IC) or an IC package.

The RF module 1029 may transmit/receive, for example, a communication signal (e.g., an RF signal). The RF module 1029 may include, for example, a transceiver, a power amplifier module (PAM), a frequency filter, a low-noise amplifier (LNA), or an antenna. According to other embodiments of the present disclosure, at least one of the cellular module 1021, the Wi-Fi module 1023, the BT module 1025, the GNSS module 1027, and the NFC module 1028 may transmit/receive an RF signal through a separate RF module.

For example, the SIM 1024 may include an embedded SIM and/or a card including an SIM, and may include unique identification information (e.g., integrated circuit card identifier (ICCID)) or subscriber information (e.g., international mobile subscriber identity (IMSI)).

The memory 1030 (e.g., the memory 130) may include, for example, an internal memory 1032 or an external memory 1034. The internal memory 1032 may include, for example, at least one of volatile memories (e.g., dynamic RAMs (DRAMs), static RAMs (SRAMs), or synchronous DRAMs (SDRAMs)) and nonvolatile memories (e.g., one-time programmable ROMs (OTPROMs), PROMs, erasable and programmable ROMs (EPROMs), electrically erasable and programmable ROMs (EEPROMs), mask ROMs, flash ROMs, flash memories (e.g., NAND flash memories or NOR flash memories), hard disk drives (HDDs), or solid state drives (SSDs)).

The external memory 1034 may include, for example, a flash drive such as compact flash (CF), SD, micro-SD, mini-SD, xD, multimedia card (MMC), or memory stick. The external memory 1034 may be operatively and/or physically connected to the electronic device 1001 through various interfaces.

For example, the sensor module 1040 may measure a physical quantity or sense an operation state of the electronic device 1001 and convert the measured or sensed information into an electrical signal. The sensor module 1040 may include, for example, at least one of a gesture sensor 1040A, a gyro sensor 1040B, a pressure sensor 1040C, a magnetic sensor 1040D, an acceleration sensor 1040E, a grip sensor 1040F, a proximity sensor 1040G, a color sensor 1040H (e.g., a red/green/blue (RGB) sensor), a biometric sensor 1040I, a temperature/humidity sensor 1040J, an illumination sensor 1040K, and an ultraviolet (UV) sensor 1040M. Additionally or alternatively, the sensor module 1040 may include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1040 may further include a control circuit configured to control at least one sensor included therein. In some embodiments of the present disclosure, the electronic device 1001 may further include a processor, which is configured separately or as a portion of the processor 1010 to control the sensor module 1040, to control the sensor module 1040 while the processor 1010 is in a sleep state.

The input device 1050 may include, for example, a touch panel 1052, a (digital) pen sensor 1054, a key 1056, or an ultrasonic input device 1058. The touch panel 1052 may include, for example, at least one of a capacitive touch panel, a resistive touch panel, an IR touch panel, and an ultrasonic touch panel. Also, the touch panel 1052 may further include a control circuit. The touch panel 1052 may further include a tactile layer configured to provide a tactile response to the user.

For example, the (digital) pen sensor 1054 may be a portion of the touch panel 1052 or may include a separate recognition sheet. The key 1056 may include, for example, a physical button, an optical key, or a keypad. The ultrasonic input device 1058 may sense an ultrasonic wave generated by an input tool through a microphone (e.g., a microphone 1088) and detect data corresponding to the sensed ultrasonic wave.

The display 1060 (e.g., the display 160) may include a panel 1062, a hologram device 1064, or a projector 1066. The panel 1062 may include an identical or similar configuration to the display 160 of FIG. 1. For example, the panel 1062 may be implemented to be flexible, transparent, or wearable. The panel 1062 and the touch panel 1052 may be configured as one module. The hologram device 1064 may display a stereoscopic image in the air by using light interference. The projector 1066 may display an image by projecting light onto a screen. For example, the screen may be located inside or outside the electronic device 1001. According to an embodiment of the present disclosure, the display 1060 may further include a control circuit for controlling the panel 1062, the hologram device 1064, or the projector 1066.

The interface 1070 may include, for example, an HDMI 1072, a USB 1074, an optical interface 1076, or a D-sub-miniature (D-SUB) 1078. For example, the interface 1070 may be included in the communication interface 170 illustrated in FIG. 1. Additionally or alternatively, the interface 1070 may include, for example, a mobile high-definition link (MHL) interface, an SD card/MMC interface, or an infrared data association (IrDA) standard interface.

For example, the audio module 1080 may perform bidirectional conversion between a sound and an electrical signal. For example, at least some components of the audio module 1080 may be included in the I/O interface 150 illustrated in FIG. 1. For example, the audio module 1080 may process sound information that is input or output through a speaker 1082, a receiver 1084, an earphone 1086, or the microphone 1088.

For example, the camera module 1091 may be configured to capture a still image and a moving image (video). According to an embodiment of the present disclosure, the camera module 1091 may include one or more image sensors (e.g., a front sensor or a rear sensor), a lens, an ISP, or a flash (e.g., an LED or a xenon lamp).

For example, the power management module 1095 may manage the power of the electronic device 1001. According to an embodiment of the present disclosure, the power management module 1095 may include a power management IC (PMIC), a charger IC, or a battery or fuel gauge. The PMIC may have a wired and/or wireless charging mode. For example, the wireless charge mode may include a magnetic resonance mode, a magnetic induction mode, or an electromagnetic wave mode and may further include an additional wireless charge circuit such as a coil loop, a resonant circuit, or a rectifier. For example, the battery gauge may be configured to measure a residual capacity, a charged voltage, a current, or a temperature of the battery 1096. The battery 1096 may include, for example, a rechargeable battery and/or a solar battery.

The indicator 1097 may indicate a particular state of the electronic device 1001 or a portion thereof (e.g., the processor 1010), such as a booting state, a message state, or a charge state. For example, the motor 1098 may be configured to convert an electrical signal into a mechanical vibration and generate a vibration or a haptic effect. Although not illustrated, the electronic device 1001 may include a processing device (e.g., a GPU) for supporting a mobile TV. For example, the processing device for supporting a mobile TV may process media data according to the standards such as digital multimedia broadcasting (DMB), digital video broadcasting (DVB), or MediaFLO™.

Each of the elements described herein may be configured by one or more components, and the names of the elements may vary according to the type of the electronic device. According to various embodiments of the present disclosure, the electronic device may be configured to include at least one of the elements described herein, and some elements may be omitted or additional elements may be further included. Also, according to various embodiments of the present disclosure, some of the elements of the electronic device may be combined into one entity to perform the same functions as the previous elements prior to the combination thereof.

Figure 11:
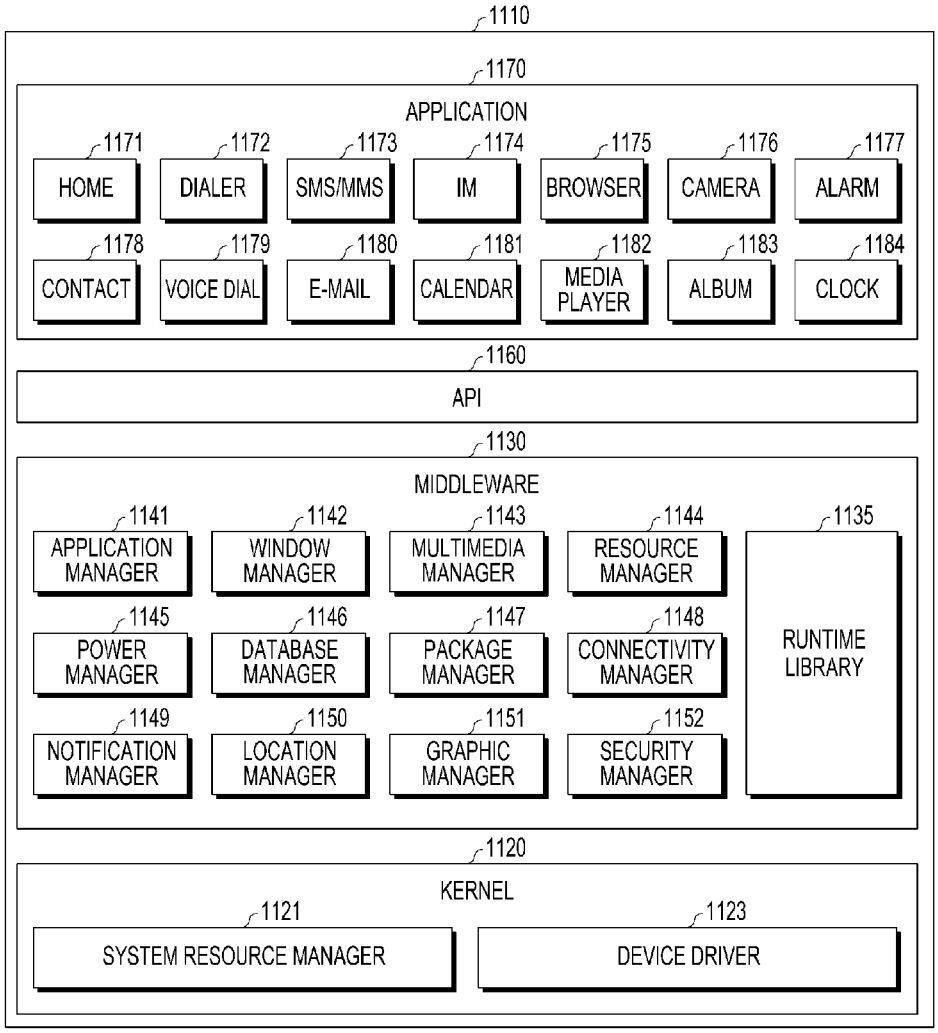
FIG. 11 is a block diagram of a program module according to various embodiments of the present disclosure.

FIG. 11 is a block diagram of a program module according to various embodiments of the present disclosure.

Referring to FIG. 11, according to an embodiment of the present disclosure, the program module 1110 (e.g., the program 140) may include an OS for controlling the resources related to the electronic device (e.g., the electronic device 101), and/or various applications (e.g., the application program 147) driven on the OS. The OS may include, for example, Android™, iOS™, Windows™, Symbian™, Tizen™, or Bada™.

The program module 1110 may include a kernel 1120, middleware 1130, an API 1160, and/or an application 1170. At least a portion of the program module 1110 may be preloaded on the electronic device or may be downloaded from the external electronic device (e.g., the electronic device 102 or 104 or the server 106).

The kernel 1120 (e.g., the kernel 141) may include, for example, a system resource manager 1121 or a device driver 1123. For example, the system resource manager 1121 may control, allocate, or recover the system resources. According to an embodiment of the present disclosure, the system resource manager 1121 may include, for example, a process managing unit, a memory managing unit, or a file system managing unit. The device driver 1123 may include, for example, a display driver, a camera driver, a BT driver, a shared memory driver, a USB driver, a keypad driver, a Wi-Fi driver, an audio driver, or an inter-process communication (IPC) driver.

For example, the middleware 1130 may provide a common function for the application 1170, or may provide various functions to the application 1170 through the API 1160 so that the application 1170 may efficiently use the limited system resources in the electronic device. According to an embodiment of the present disclosure, the middleware 1130 (e.g., the middleware 143) may include at least one of a runtime library 1135, an application manager 1141, a window manager 1142, a multimedia manager 1143, a resource manager 1144, a power manager 1145, a database (DB) manager 1146, a package manager 1147, a connectivity manager 1148, a notification manager 1149, a location manager 1150, a graphic manager 1151, and a security manager 1152.

The runtime library 1135 may include, for example, a library module that is used by a compiler to add a new function through a programming language while the application 1170 is being executed. The runtime library 1135 may perform I/O management, memory management, or arithmetical functions.

For example, the application manager 1141 may manage the life cycle of at least one of the application 1170. The window manager 1142 may manage the graphical user interface (GUI) resources used in the screen. The multimedia manager 1143 may detect a format necessary for playing various media files and perform encoding or decoding on a media file by using a codec according to the detected format. The resource manager 1144 may manage the resource of a memory or a storage space and the source code of at least one of the application 1170.

For example, by operating together with a basic input/output system (BIOS), the power manager 1145 may manage the battery or the power supply and provide power information necessary for the operation of the electronic device. The DB manager 1146 may generate, search, or modify a DB to be used by at least one of the application 1170. The package manager 1147 may manage the update or installation of an application that is distributed in the form of a package file.

For example, the connectivity manager 1148 may manage wireless connection such as Wi-Fi or BT. The notification manager 1149 may display or notify an event such as message arrival, engagement, or proximity alarm to the user in an undisturbed manner. The location manager 1150 may manage the location information of the electronic device. The graphic manager 1151 may manage a graphic effect to be provided to the user, or a UI related thereto. For example, the security manager 1152 may provide various security functions necessary for user authentication or system security. According to an embodiment of the present disclosure, when the electronic device (e.g., the electronic device 101) includes a phone function, the middleware 1130 may further include a telephony manager for managing a voice or video call function of the electronic device.

The middleware 1130 may include a middleware module for providing a combination of the various functions of the above-described components. The middleware 1130 may provide a specialized module for each OS type in order to provide a specialized function. Also, the middleware 1130 may dynamically delete some of the existing components or add new components.

For example, as a set of API programming functions, the API 1160 (e.g., the API 145) may be provided as different configurations according to the OS types. For example, Android™ or iOS™ may provide one API set for each platform, and Tizen™ may provide two or more API sets for each platform.

For example, the application 1170 (e.g., the application program 147) may include one or more applications that may perform one or more functions such as a home 1171, a dialer 1172, a short message service (SMS)/multimedia messaging service (MMS) 1173, an instant message (IM) 1174, a browser 1175, a camera 1176, an alarm 1177, a contact 1178, a voice dial 1179, an e-mail 1180, a calendar 1181, a media player 1182, an album 1183, a clock 1184, healthcare (e.g., exercise amount or blood sugar measurement), or provision of environment information (e.g., pressure, humidity, or temperature information).

According to an embodiment of the present disclosure, the application 1170 may include an application (hereinafter referred to as "information communication application" for convenience of description) for supporting information communication between the electronic device (e.g., the electronic device 101) and the external electronic device (e.g., the electronic device 102 or 104). The information communication application may include, for example, a notification relay application for transmitting particular information to the external electronic device, or a device management application for managing the external electronic device.

For example, the notification relay application may include a function for transmitting notification information, which is generated by other applications of the electronic device (e.g., an SMS/MMS application, an e-mail application, a healthcare application, or an environment information application), to the external electronic device (e.g., the electronic device 102 or 104). Also, for example, the notification relay application may receive notification information from the external electronic device and provide the received notification information to the user.

For example, the device management application may manage (e.g., install, delete, or update) at least one function (e.g., turn-on/off of the external electronic device (or some components thereof) or control of the display brightness (or resolution)) of the external electronic device (e.g., the electronic device 102 or 104) communicating with the electronic device, or a service (e.g., a call service or a message service) provided by the external electronic device or the application operating in the external electronic device.

According to an embodiment of the present disclosure, the application 1170 may include an application (e.g., a healthcare application of a mobile medical device) specified according to the attribute of the external electronic device (e.g., the electronic device 102 or 104). According to an embodiment of the present disclosure, the application 1170 may include an application received from the external electronic device (e.g., the server 106 or the electronic device 102 or 104). According to an embodiment of the present disclosure, the application 1170 may include a preloaded application or a third party application that may be downloaded from the server. The names of the components of the program module 1110 according to the illustrated embodiments of the present disclosure may vary according to the OS types.

According to various embodiments of the present disclosure, at least a portion of the program module 1110 may be implemented in software, firmware, hardware, or any combination thereof. For example, at least a portion of the program module 1110 may be implemented (e.g., executed) by the processor (e.g., the processor 120). For example, at least a portion of the program module 1110 may include a module, a program routine, an instruction set, or a process for performing one or more functions.

The term "module" used herein may refer to, for example, a unit including hardware, software, firmware, or any combination thereof. For example, the term "module" may be interchangeably used with terms such as "unit," "logic,", "logical block," "component," or "circuit". The "module" may be a portion or a minimum unit of an integrated component. The "module" may be a portion or a minimum unit for performing one or more functions. The "module" may be implemented mechanically or electronically. For example, the "module" may include at least one of an application-specific IC (ASIC) chip, a field-programmable gate array (FPGA), or a programmable-logic device for performing some operations, which are known or to be developed.

For example, at least a portion of the device (e.g., modules or functions thereof) or method (e.g., operations) according to various embodiments may be implemented in the form of a program module by instructions stored in computer-readable storage media. When the instructions are executed by the processor (e.g., the processor 120), the one or more processors may perform a function corresponding to the instructions. The computer-readable storage media may include, for example, the memory 130.

The computer-readable storage media may include, for example, hard disks, floppy disks, magnetic media (e.g., magnetic tapes), optical media (e.g., compact disk ROM (CD-ROM), DVD, magneto-optical media (e.g., floptical disks), or hardware devices (e.g., ROM, RAM, or flash memories). Also, the program commands may include machine language codes that may be generated by a compiler, and high-level language codes that may be executed by a computer by using an interpreter. The hardware device may be configured to operate as one or more software modules in order to perform the operation of various embodiments of the present disclosure, and vice versa.

The program module or the module according to various embodiments may include at least one of the above elements, some of the above elements may be omitted, or additional other elements may be further included therein. The operations performed by the module, the program module, or other elements according to various embodiments of the present disclosure may be executed in a sequential, parallel, repeated, or heuristic manner. Also, some operations may be executed in different order or omitted, or other operations may be additionally executed.

According to various embodiments of the present disclosure, a computer-readable recording medium may store a program executed in a computer, wherein the program may include an executable command executed by a processor to cause the processor to perform an operation of acquiring a sound source corresponding to at least one sound source button selected among a plurality of sound source buttons corresponding respectively to a plurality of different sound sources, an operation of receiving an input to at least one key of a keyboard displayed on the screen of the electronic device, and an operation of reproducing the sound source corresponding to the selected at least one sound source button as a sound corresponding to the received input.

As described above, by the electronic devices and the methods for reproducing sounds in the electronic devices according to various embodiments of the present disclosure, since the sound sources corresponding respectively to the sound source buttons selected among the sound source buttons displayed on the screen may be simultaneously or sequentially reproduced as the corresponding sounds according to the key input, a desired music may be produced and played by mixing the sound sources in various forms.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a touchscreen configured to display a keyboard having a plurality of keys and a plurality of sound source buttons corresponding respectively to a plurality of different sound sources;

a processor electrically connected to the touchscreen; and a memory electrically connected to the processor, wherein the memory stores instructions that are executed to cause the processor to:

receive an input for selecting at least two sound source buttons among the plurality of sound source buttons, acquire at least two sound sources corresponding to the selected at least two sound source buttons, when an input to at least two keys included in the keyboard displayed on the touchscreen is received, sequentially generate output sounds having at least two pitch corresponding to the at least two keys by sequentially and alternately using the acquired at least two sound sources, and output the generated output sounds sequentially.

2. The electronic device of claim 1, wherein the processor is further configured to generate an output sounds having the pitch corresponding to the input to the at least one key by simultaneously using the acquired at least two sound sources.

3. The electronic device of claim 1, wherein the processor is further configured to control such that at least one sound source button not displayed on the touchscreen is displayed on the touchscreen according to a user's gesture for moving the plurality of sound source buttons displayed on the touchscreen.

4. The electronic device of claim 1, wherein the processor is further configured to display a button for selecting a play mode on the touchscreen, and display a scroll bar for displaying a key not displayed on the touchscreen by moving a plurality of keys of the keyboard displayed on the touchscreen.

5. The electronic device of claim 1, wherein the memory is configured to store different sound sources set corresponding respectively to the plurality of sound source buttons.

6. The electronic device of claim 5, wherein the sound source includes at least one of prestored audio content, a user's voice input from the user, or a natural sound input by the user.

7. A method for reproducing a sound in an electronic device, the method comprising:

receiving an input for selecting at least two sound source buttons among a plurality of sound source buttons corresponding respectively to a plurality of different sound sources;

acquiring at least two sound sources corresponding to the selected at least two sound source buttons;

receiving an input to at least one key two keys of a keyboard displayed on a touchscreen of the electronic device;

sequentially generating output sounds having at least two pitch corresponding to the at least two keys by sequentially and alternately using the acquired at least two sound sources; and outputting the generated output sounds sequentially.

8. The method of claim 7, further comprising generating an output sounds having the pitch corresponding to the input to the at least one key by simultaneously using the acquired at least two sound sources.

9. The method of claim 7, further comprising displaying at least one sound source button not displayed on the touchscreen, on the touchscreen according to a user's gesture for moving the plurality of displayed sound source buttons.

10. The method of claim 7, further comprising displaying a key not displayed on the touchscreen by moving a plurality of keys of the keyboard displayed on the touchscreen.

11. The method of claim 7, wherein the sound source includes at least one of prestored audio content, a user's voice input from the user, or a natural sound input by the user.

12. A non-transitory computer-readable recording medium storing a program executed in a computer, the program comprising an executable command executed by a processor to cause the processor to perform:

an operation of receiving an input for selecting at least two sound source buttons among a plurality of sound source buttons corresponding respectively to a plurality of different sound sources;

an operation of acquiring at least two sound sources corresponding to the selected at least two sound source buttons;

an operation of receiving an input to at least two keys of a keyboard displayed on a touchscreen of an electronic device;

an operation of sequentially generating output sounds having at least two pitch corresponding to the at least two keys by sequentially and alternately using the acquired at least two sound sources; and an operation of outputting the generated output sounds sequentially.

* * * * *